US009318858B2

(12) United States Patent
Saito et al.

(10) Patent No.: US 9,318,858 B2
(45) Date of Patent: Apr. 19, 2016

(54) RECEPTACLE CONNECTOR, PLUG CONNECTOR AND CONNECTOR ASSEMBLY

(71) Applicants: Japan Aviation Electronics Industry, Limited, Tokyo (JP); JAE Electronics, Inc., Irvine, CA (US)

(72) Inventors: Yuichi Saito, Tokyo (JP); Takeharu Naito, Tokyo (JP); Kazushi Kamata, Irvine, CA (US); Cedrec Sumimoto, Irvine, CA (US)

(73) Assignees: Japan Aviation Electronics Industry, Limited, Tokyo (JP); JAE Electronics, Inc., Irvine, CA (US)

( * ) Notice: Subject to any disclaimer, the term of this patent is extended or adjusted under 35 U.S.C. 154(b) by 9 days.

(21) Appl. No.: 14/296,128

(22) Filed: Jun. 4, 2014

(65) Prior Publication Data

US 2015/0222064 A1 Aug. 6, 2015

Related U.S. Application Data

(60) Provisional application No. 61/934,946, filed on Feb. 3, 2014.

(51) Int. Cl.

| | |
|---|---|
| ***H01R 27/00*** | (2006.01) |
| *H01R 12/73* | (2011.01) |
| *H01R 24/60* | (2011.01) |

(52) U.S. Cl.

CPC ..... *H01R 27/00* (2013.01); *H01R 12/732* (2013.01); *H01R 24/60* (2013.01)

(58) Field of Classification Search

CPC ..... H01R 27/00; H01R 31/06

USPC ..... 439/218, 604, 660

See application file for complete search history.

(56) References Cited

U.S. PATENT DOCUMENTS

| | | | | |
|---|---|---|---|---|
| 8,133,078 | B2 * | 3/2012 | Lin et al. | 439/660 |
| 8,408,940 | B2 * | 4/2013 | Chang | 439/607.01 |
| 2008/0299831 | A1 | 12/2008 | Kim | |

FOREIGN PATENT DOCUMENTS

| | | |
|---|---|---|
| JP | 2008301492 | 12/2008 |

* cited by examiner

*Primary Examiner* — Phuong Dinh

(74) *Attorney, Agent, or Firm* — Muncy, Geissler, Olds & Lowe, P.C.

(57) ABSTRACT

A receptacle connector comprises a receptacle shell, a receptacle contact array A and a receptacle contact array B, a plurality of contact portions of the receptacle contact array A and a plurality of contact portions of the receptacle contact array B facing in opposite directions to each other, when a plug connector having a first fitting section is fitted to the receptacle connector, at least the plurality of contact portions of the receptacle contact array B are connected to the plug connector having the first fitting section, and when the plug connector having a second fitting section is fitted to the receptacle connector, the plurality of contact portions of the receptacle contact array A are connected to the plug connector having the second fitting section.

14 Claims, 11 Drawing Sheets

RECEPTACLE CONNECTOR, PLUG CONNECTOR AND CONNECTOR ASSEMBLY

BACKGROUND OF THE INVENTION

The present invention relates to a receptacle connector, and more particularly, to a receptacle connector which can be fitted to any of a plug connector having a first fitting section and another plug connector having a second fitting section of a shape different from the shape of the first fitting section along the same fitting axis.

The present invention also relates to a plug connector that is fitted to the receptacle connector.

The present invention also relates to a connector assembly comprising the receptacle connector and the plug connector.

In recent years, with a decrease in size and an increase in density of electronic devices such as portable devices and information devices, there is a demand for a decrease in size of a connector used to send and receive signals and power to and from external apparatuses. In addition, a standardized connector such as a micro universal serial bus (μUSB) is widely used to secure connection compatibility.

In such an electronic device, when sending and receiving of signals and power are needed using means other than the RUSB for the purpose of function enhancement and the like, it is necessary to equip an electronic device with a non-USB small connector in addition to a USB connector.

However, mounting of two connectors requires a large mounting space and the number of components increases, thereby increasing costs.

Therefore, there is a need for equipping an electronic device with a receptacle connector that can be fitted to both a USB plug connector and a non-USB plug connector.

As such a receptacle connector having connection compatibility with two types of plug connectors, for example, a receptacle connector 1 illustrated in FIG. 23 is disclosed in JP 2008-301492 A.

The receptacle connector 1 has a structure in which a receptacle contact array 4 for a universal serial bus (USB) and a non-USB receptacle contact array 5 are held at different heights in an insulator 3 surrounded with a shell 2. Each of plural contacts constituting the USB receptacle contact array 4 has a contact portion 7 that extends in a direction of a fitting axis L of the receptacle connector 1 and that is exposed to a plug-receiving space 6 formed in the shell 2. Similarly, each of plural contacts constituting the non-USB receptacle contact array 5 has a contact portion 8 that extends in the direction of the fitting axis L of the receptacle connector 1 and that is exposed to the plug-receiving space 6. The contact portions 7 of the contacts of the USB receptacle contact array 4 and the contact portions 8 of the contacts of the non-USB receptacle contact array 5 are located at different positions in the direction of the fitting axis L and face to the same direction, that is, to the lower side in FIG. 23.

When a fitting section of a USB plug connector is inserted into the plug-receiving space 6 of the receptacle connector 1, contact portions of plural plug contacts of the plug connector come in contact with the contact portions 7 of the corresponding contacts of the USB receptacle contact array 4 and thus the USB plug connector is connected to the receptacle connector 1. On the other hand, when a fitting section of a non-USB plug connector is inserted into the plug-receiving space 6, contact portions of plural plug contacts of the plug connector come in contact with the contact portions 8 of the corresponding contacts of the non-USB receptacle contact array 5 and thus the non-USEB plug connector is connected to the receptacle connector 1.

In this way, the receptacle connector 1 can be fitted to any of the USB plug connector and a non-USB plug connector.

However, in the receptacle connector 1 disclosed in JP 2008-301492 A, by arranging the contact portions 7 of the contacts of the USB receptacle contact array 4 and the contact portions 8 of the contacts of the non-USB receptacle contact array 5 at different positions in the direction of the fitting axis L so as to face the same side, connection compatibility between the USB plug connector and the non-USB plug connector is secured. Accordingly, there is a problem in that the length of the receptacle connector 1 in the direction of the fitting axis L has to increase.

Particularly, in recent portable devices and information devices, for example, as illustrated in FIG. 24, a receptacle connector 9 is often installed outside a display screen 10 with a fitting axis L set to be parallel to the display screen 10 in order to achieve a decrease in thickness and an increase in size of the display screen, and thus there is a need for a receptacle connector having a small length in the direction of the fitting axis L.

SUMMARY OF THE INVENTION

The present invention is made to solve the above-mentioned problem in the prior art and an object thereof is to provide a receptacle connector which has connection compatibility with two types of plug connectors having fitting sections of different shapes and which can reduce the length in a fitting axis direction.

Another object of the present invention is to provide a plug connector which can be fitted to the receptacle connector.

Still another object of the present invention is to provide a connector assembly comprising the receptacle connector and the plug connector.

A receptacle connector according to a first invention is to be fitted to either of a plug connector having a first fitting section and a plug connector having a second fitting section different in shape from the first fitting section along a same fitting axis, the receptacle connector comprising:

a receptacle shell in which a first reception section for receiving the first fitting section and a second reception section for receiving the second fitting section are formed to overlap at least partly with each other; and a receptacle contact array A and a receptacle contact array B, both having a plurality of contact portions that are arranged in a region of the receptacle shell where the first reception section and the second reception section overlap with each other, wherein the plurality of contact portions of the receptacle contact array A and the plurality of contact portions of the receptacle contact array B face in opposite directions to each other, wherein when the plug connector having the first fitting section is fitted to the receptacle connector, at least the plurality of contact portions of the receptacle contact array B out of the plurality of contact portions of the receptacle contact array A and the plurality of contact portions of the receptacle contact array B are connected to the plug connector having the first fitting section, and when the plug connector having the second fitting section is fitted to the receptacle connector, the plurality of contact portions of the receptacle contact array A are connected to the plug connector having the second fitting section.

A plug connector according to a second invention comprises:

the first fitting section that is to be received in the first reception section of the receptacle connector according to the first invention;

a plug contact array C that corresponds to the receptacle contact array A; and a plug contact array D that corresponds to the receptacle contact array B, wherein a plurality of contact portions of the plug contact array C and a plurality of contact portions of the plug contact array D are arranged so as to face each other, and wherein when the plug connector is fitted to the receptacle connector, the plurality of contact portions of the plug contact array C are connected to the plurality of contact portions of the receptacle contact array A and the plurality of contact portions of the plug contact array D are connected to the plurality of contact portions of the receptacle contact array B.

A connector assembly according to a third invention comprising:

the receptacle connector according to the first invention;

a first plug connector that is the plug connector according to the second invention; and a second plug connector that includes the second fitting section which is to be received in the second reception section of the receptacle connector and a plug contact array E corresponding to the receptacle contact array A and in which a plurality of contact portions of the plug contact array E are connected to the plurality of contact portions of the receptacle contact array A when the second plug connector is fitted to the receptacle connector, wherein one of the first plug connector and the second plug connector is fitted to the receptacle connector.

DETAILED DESCRIPTION OF THE INVENTION

Hereinafter, embodiments of the present invention will be described with reference to the accompanying drawings.

Figure 1:
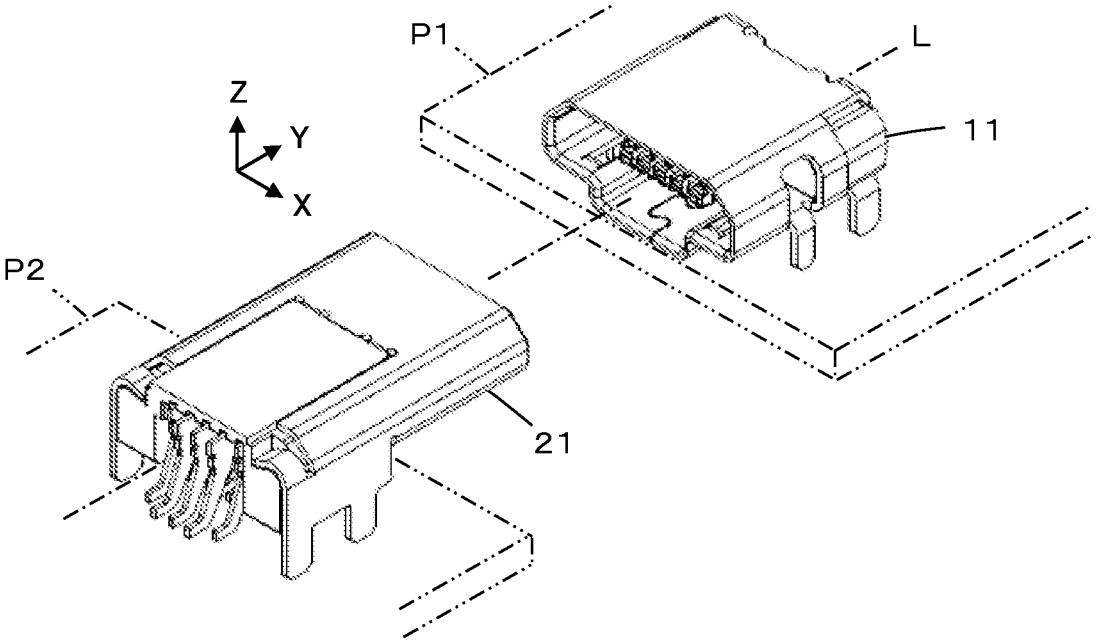
FIG. 1 is a perspective view illustrating a state where a receptacle connector according to an embodiment of the present invention and a first plug connector are not fitted to each other.
Figure 2A:
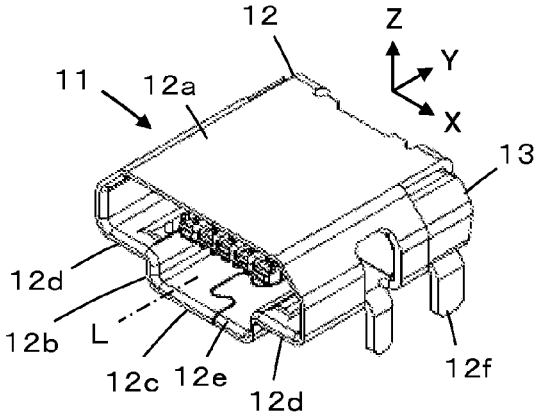
FIG. 2A is a perspective view of the receptacle connector when viewed from a front oblique upper side.
Figure 2B:
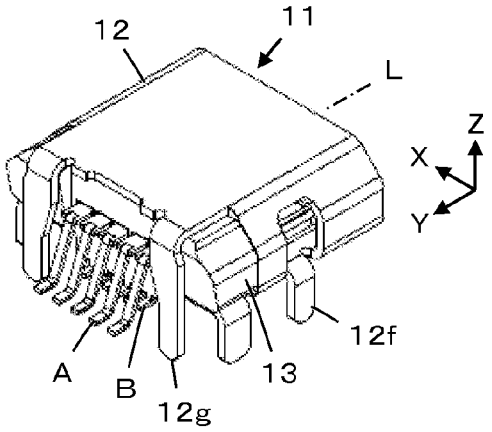
FIG. 2B is a perspective view thereof when viewed from a rear oblique upper side.
Figure 2C:
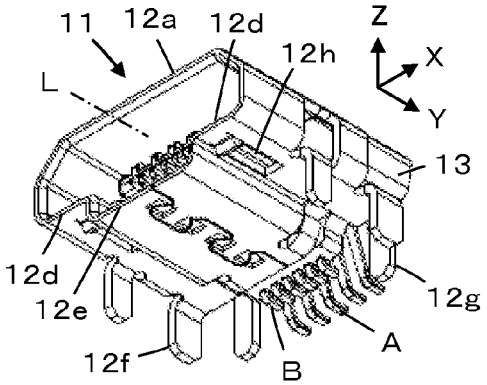
FIG. 2C is a perspective view thereof when viewed from a front oblique lower side.
Figure 2D:
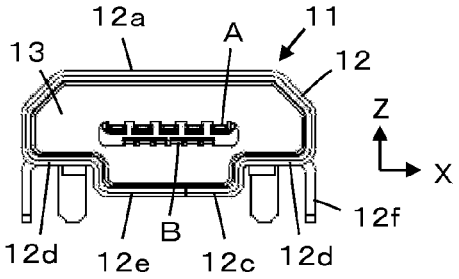
FIG. 2D is a front view thereof.
Figure 2E:
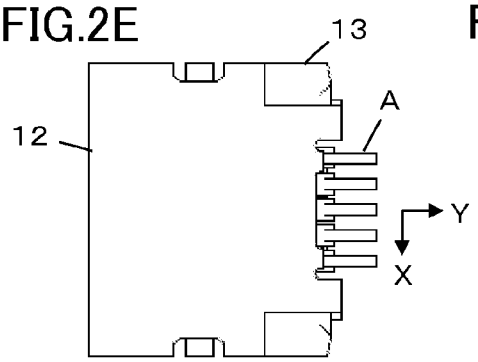
FIG. 2E is a plan view thereof.
Figure 2F:
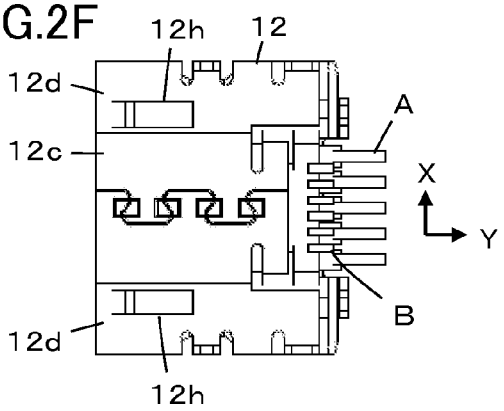
FIG. 2F is a bottom view thereof.
Figure 2G:
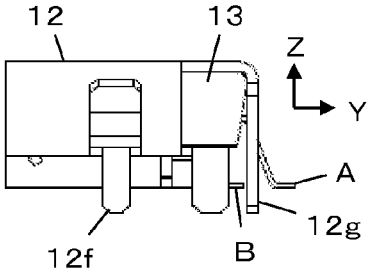
FIG. 2G is a side view thereof.
Figure 2H:
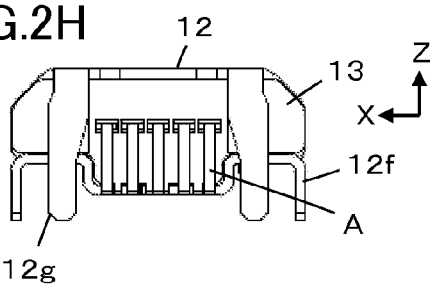
FIG. 2H is a rear view thereof.

FIG. 1 illustrates a receptacle connector 11 and a first plug connector 21 according to an embodiment of the present invention. The receptacle connector 11 is fixed to a circuit board P1 in an electronic device such as a portable device, information device, and the like, and the first plug connector 21 is fixed to another circuit board P2. The first plug connector 21 is placed to abut the receptacle connector 11 and pushed along a fitting axis L to be thereby fitted to the receptacle connector 11.

Here, it is assumed that the circuit boards P1 and P2 are flush with each other, and for the purpose of convenience of explanation, the surface of the circuit board P1 is defined as an XY plane, the direction in which the fitting axis L extends from the first plug connector 21 to the receptacle connector 11 is defined as a +Y direction, and the direction perpendicular to the XY plane is defined as a Z direction.

As illustrated in FIGS. 2A to 2H, the receptacle connector 11 has a receptacle shell 12, a receptacle insulator 13 is disposed inside the receptacle shell 12, and receptacle contact array A and receptacle contact array B are held by the receptacle insulator 13.

Receptacle contact array A is a contact array corresponding to a standardized general-purpose micro universal serial bus (μUSB), and receptacle contact array B is a contact array for sending and receiving signals or signals and power using a bus other than μUSB. Each of receptacle contact array A and receptacle contact array B includes plural receptacle contacts which extend along the fitting axis L of the receptacle connector 11 and which are arranged in the direction perpendicular to the fitting axis L. The arrangement surface of the receptacle contacts in receptacle contact array A and the arrangement surface of the receptacle contacts in receptacle contact array B are parallel to each other.

The receptacle shell 12 is formed of a metal material and has a hollow shape which is flat in the X direction perpendicular to the fitting axis L and of which both ends, that is, the front end and the rear end, in the Y direction parallel to the fitting axis L are opened. The receptacle shell 12 has an upper plate section 12*a* and a lower plate section 12*b* facing each other in the Z direction. A convex section 12*c* swelling downward along the fitting axis L is formed in the central portion of the lower plate section 12*b* in the X direction. By presence of the convex section 12*c*, the lower plate section 12*b* includes a pair of upper step sections 12*d* located on both sides of the convex section 12*c* in the X direction and extending in the Y direction and a lower step section 12*e* located at a position on the −Z direction side of the upper step section 12*d* between the pair of upper step sections 12*d* and extending in the Y direction between the pair of upper step sections 12*d*.

The receptacle shell 12 includes plural protrusions 12*f* protruding in the −Z direction from a lateral edge extending in the Y direction of the upper step section 12*d* of the lower plate section 12*b* and a pair of protrusions 12*g* protruding in the −Z direction from an end in the +Y direction (on the rear surface side) of the upper plate section 12*a*. The protrusions 12*f* protruding from the upper step section 12*d* of the lower plate section 12*b* are inserted into through-holes of the circuit board P1 and are soldered thereto to fix the receptacle connector 11 to the circuit board P1. The protrusions 12*g* protruding from the upper plate section 12*a* hold the receptacle insulator 13, which is disposed inside the receptacle shell 12, in the receptacle shell 12.

An opening 12*h* for holding a locking member of a plug connector fitted to the receptacle connector 11 is formed in each of the pair of upper step sections 12*d* of the lower plate section 12*b* of the receptacle shell 12.

Figure 3:
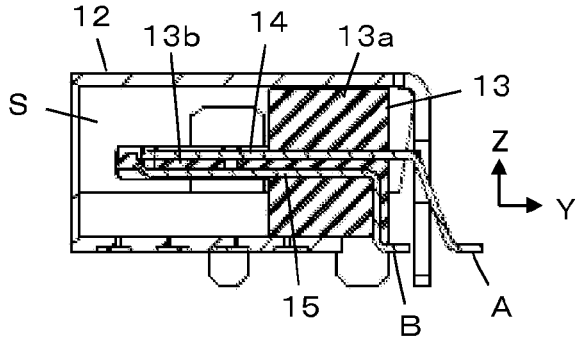
FIG. 3 is a cross-sectional view of the receptacle connector.

The receptacle insulator 13 is inserted into the receptacle shell 12. As illustrated in FIG. 3, the receptacle insulator 13 includes an insulator body 13*a* filling a region on the +Y direction side (on the rear surface side) in the internal space of the receptacle shell 12 and a tongue-like section 13*b* extending to the −Y direction side (to the front side) along the fitting axis L from the insulator body 13*a*. The tongue-like section 13*b* has a flat shape extending in the XY plane, does not come in contact with the inner wall of the receptacle shell 12, and is located at the center in the receptacle shell 12. A reception space S for receiving a fitting section of a plug connector is secured around the tongue-like section 13*b* in the region on the −Y direction side (on the front surface side) in the internal space of the receptacle shell 12.

Receptacle contact array A includes plural receptacle contacts 14 which extend in the Y direction along the fitting axis L and which are arranged in the X direction. Similarly, receptacle contact array B includes plural receptacle contacts 15 which extend in the Y direction along the fitting axis L and which are arranged in the X direction, that is, in the direction parallel to receptacle contact array A.

Receptacle contact array A and receptacle contact array B are arranged to overlap with each other with a predetermined gap interposed therebetween in the Z direction perpendicular to the arrangement direction thereof, and ends in the −Y direction of the receptacle contacts 14 of receptacle contact array A and ends in the −Y direction of receptacle contacts 15 of receptacle contact array B are arranged at the same position in the Y direction along the fitting axis L.

Figure 4A:
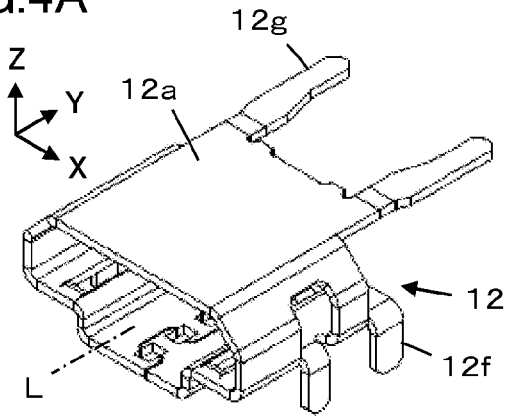
FIG. 4A is a perspective view of a receptacle shell used for the receptacle connector before being assembled when viewed from the front side and FIG. 4B is a perspective view thereof when viewed from the rear side.
Figure 4B:
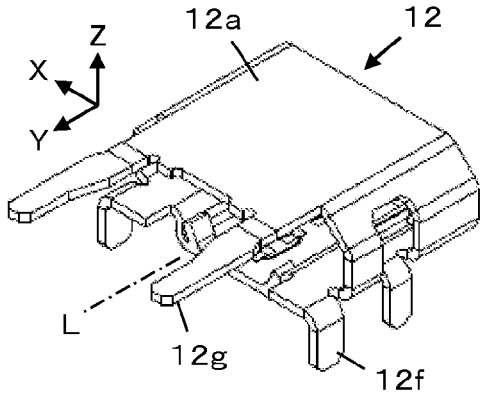

As illustrated in FIGS. 4A and 4B, the protrusions 12*g* protruding from the upper plate section 12*a* of the receptacle shell 12 extend along the fitting axis L so as to be flush with the upper plate section 12*a* without being bent at ends of the upper plate section 12*a* before the receptacle insulator 13 is attached, and are bent so as to extend in the −Z direction as illustrated in FIGS. 2A to 2H after the receptacle insulator 13 is inserted into the receptacle shell 12. Accordingly, the receptacle insulator 13 disposed in the receptacle shell 12 is held by the receptacle shell 12.

Figure 5A:
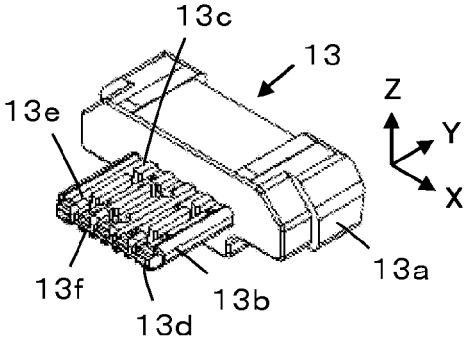
FIG. 5A is a perspective view of a receptacle insulator used for the receptacle connector when viewed from the front side and FIG. 5B is a perspective view thereof when viewed from the rear side.
Figure 5B:
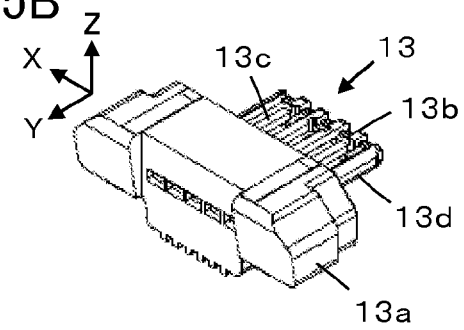

As illustrated in FIGS. 5A and 5B, the tongue-like section 13*b* of the receptacle insulator 13 has a pair of surfaces facing the opposite directions to each other, that is, an upper surface 13*c* facing the +Z direction side and a lower surface 13*d* facing the −Z direction side. Plural grooves 13*e* for receiving a part of the receptacle contacts 14 of receptacle contact array A are formed on the upper surface 13*c*, and plural grooves 13*f* for receiving a part of the receptacle contacts 15 of receptacle contact array B are formed on the lower surface 13*d*.

Figure 6A:
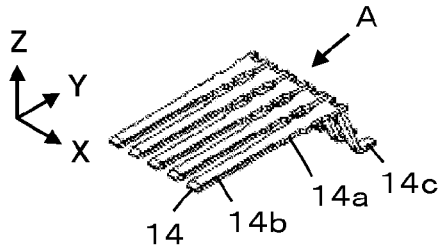
FIG. 6A is a perspective view of receptacle contact array A used for the receptacle connector when viewed from the front side and FIG. 6B is a perspective view thereof when viewed from the rear side.
Figure 6B:
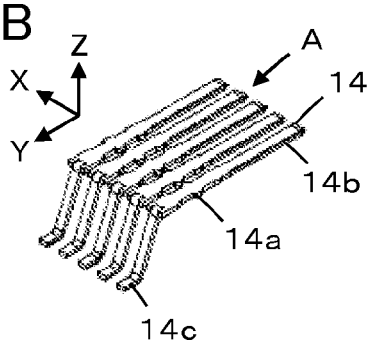

FIGS. 6A and 6B illustrate receptacle contact array A. Each of the receptacle contacts 14 of receptacle contact array A includes a held portion 14*a* embedded and held in the receptacle insulator 13, a contact portion 14*b* located on the −Y direction side of the held portion 14*a* and inserted into the groove 13*e* of the tongue-like section 13*b* of the receptacle insulator 13, and a substrate-mounting portion 14*c* located on the +Y direction side of the held portion 14*a* and protruding from the back of the receptacle insulator 13.

Figure 7A:
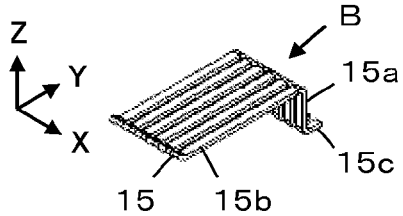
FIG. 7A is a perspective view of receptacle contact array B used for the receptacle connector when viewed from the front side and FIG. 7B is a perspective view thereof when viewed from the rear side.
Figure 7B:
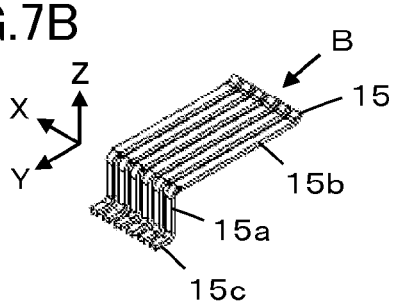

Similarly, FIGS. 7A and 7B illustrate receptacle contact array B. Each of the receptacle contacts 15 of receptacle contact array B includes a held portion 15*a* embedded and held in the receptacle insulator 13, a contact portion 15*b* located on the −Y direction side of the held portion 15*a* and inserted into the groove 13*f* of the tongue-like section 13*b* of the receptacle insulator 13, and a substrate-mounting portion 15*c* located on the +Y side of the held portion 15*a* and protruding from the back of the receptacle insulator 13.

Figure 8A:
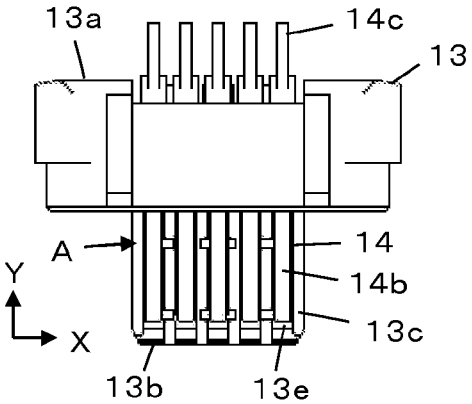
FIG. 8A is a plan view of the receptacle insulator holding receptacle contact array A and receptacle contact array B.
Figure 8B:
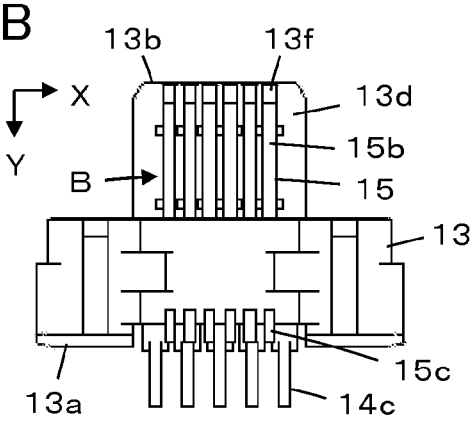
FIG. 8B is a bottom view thereof.
Figure 8C:
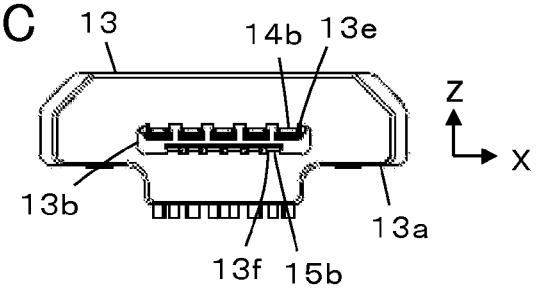
FIG. 8C is a front view thereof.

Receptacle contact array A and receptacle contact array B can be attached to the receptacle insulator 13, for example, by insert molding using a resin, as illustrated in FIGS. 8A to 8C. The contact portions 14*b* of the receptacle contacts 14 of receptacle contact array A are inserted into the grooves 13*e* formed on the upper surface 13*c* which is one surface of a pair of surfaces of the tongue-like section 13*b* of the receptacle insulator 13, and the contact portions 15*b* of the receptacle contacts 15 of receptacle contact array B are inserted into the grooves 13*f* formed on the lower surface 13*d* which is the other surface thereof.

As illustrated in FIG. 8B, the substrate-mounting portions 14*c* of the respective receptacle contacts 14 of receptacle contact array A and the substrate-mounting portions 15*c* of the respective receptacle contacts 15 of receptacle contact array B are located at positions different in the Y direction from each other. Accordingly, when the receptacle connector 11 is mounted on the circuit board P1, the substrate-mounting portions 14*c* and the substrate-mounting portions 15*c* can be soldered to wiring patterns of the circuit board P1 in a state where a space therebetween is satisfactorily secured.

Figure 9:
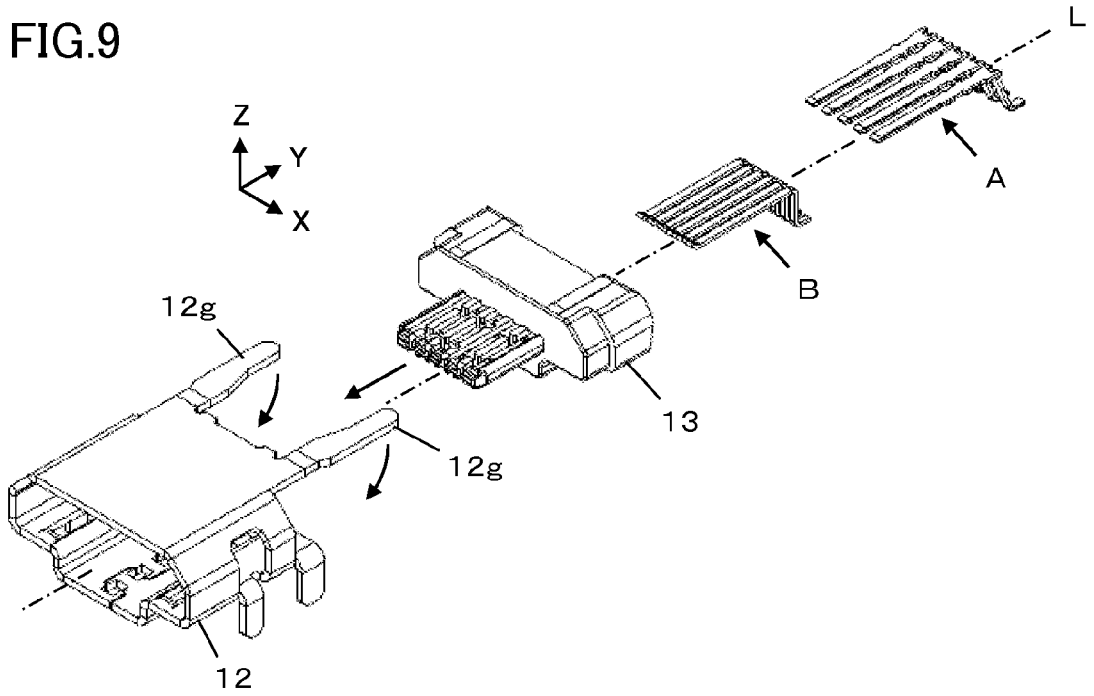
FIG. 9 is an exploded view of the receptacle connector.

The receptacle insulator 13 having receptacle contact array A and receptacle contact array B attached thereto is inserted into the receptacle shell 12 from the end on the +Y direction side of the receptacle shell 12 along the fitting axis L as illustrated in FIG. 9, and the pair of protrusions 12*g* of the receptacle shell 12 are bent to the −Z direction side to hold the receptacle insulator 13 in the receptacle shell 12, whereby the receptacle connector 11 is prepared.

Figure 10A:
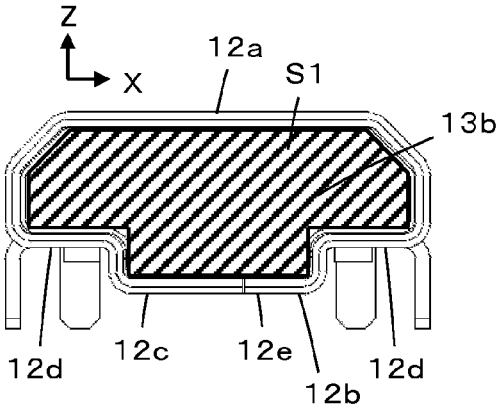
FIG. 10A is a front view illustrating a first reception section of the receptacle connector and FIG. 10B is a front view illustrating a second reception section of the receptacle connector.
Figure 10B:
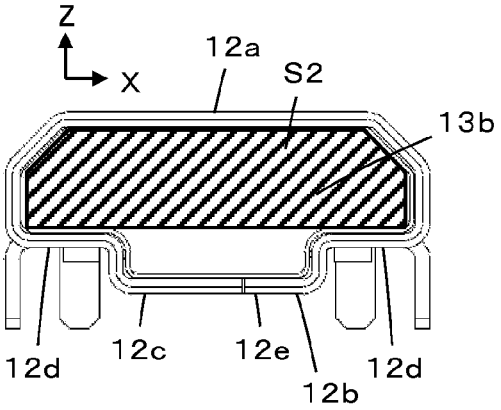

In the receptacle connector 11, since the convex section 12*c* swelling downward is formed in the lower plate section 12*b* of the receptacle shell 12, a first reception section S1 indicated by a hatched part in FIG. 10A and a second reception section S2 indicated by a hatched part in FIG. 10B are formed to overlap at least a part thereof in the reception space S secured inside the receptacle shell 12 on the front side. The first reception section S1 is defined by the upper plate section 12*a* and the pair of upper step sections 12*d* and the lower step section 12*e* of the lower plate section 12*b*, and the second reception section S2 is defined by the upper plate section 12*a* and the pair of upper step sections 12*d* of the lower plate section 12*b*.

In the first reception section S1 and the second reception section S2, the tongue-like section 13*b* of the receptacle insulator 13 is located in the overlapping region.

Next, the configuration of the first plug connector 21 which can be inserted into the first reception section S1 of the receptacle connector 11 is illustrated in FIGS. 11A to 11G. The first plug connector 21 is not a general-purpose connector but is a dedicated plug connector which is fitted to only the receptacle connector 11.

The first plug connector 21 has a plug shell 22, a plug insulator 23 is disposed in the plug shell 22, and plug contact array C and plug contact array D are held by the plug insulator 23.

Plug contact array C is used to send and receive signals and power for a USB, and plug contact array D is used to send and receive signals or signals and power for a bus other than the USB. Each of plug contact array C and plug contact array D includes plural plug contacts which extend along the fitting axis L of the first plug connector 21 and which are arranged in the direction perpendicular to the fitting axis L. The arrangement surface of the plug contacts in plug contact array C and the arrangement surface of the plug contacts in plug contact array D are parallel to each other.

A first fitting section F1 which is fitted to the first reception section S1 of the receptacle connector 11 is formed at an end on the +Y direction side (on the front surface side) of the first plug connector 21.

The plug shell 22 is formed of a metal material. The plug shell 22 in the first fitting section F1 has a hollow shape which is flat in the X direction perpendicular to the fitting axis L and of which both ends, that is, the front end and the rear end, in the Y direction parallel to the fitting axis L are opened. The plug shell 22 in the first fitting section F1 includes an upper plate section 22*a* and a lower plate section 22*b* facing each other in the Z direction. A convex section 22*c* swelling downward along the fitting axis L is formed in the central portion of the lower plate section 22*b* in the X direction. By presence of the convex section 22*c*, the lower plate section 22*b* includes a pair of upper step sections 22*d* located on both sides in the X direction of the convex section 22*c* and extending in the Y direction and a lower step section 22*e* located at a position lower than the upper step section 22*d* between the pair of upper step sections 22*d* and extending in the Y direction.

Four protrusions 22*f* protruding to the −Z direction side from the lower end of the plug shell 22 and a pair of protrusions 22*g* being bent and extending from the upper end of the plug shell 22 so as to receive the end of the plug insulator 23 in the −Y direction are formed at the end on the −Y direction side (the rear surface side) of the plug shell 22. The protrusions 22*f* are inserted into through-holes of the circuit board P2 and are soldered thereto to fix the first plug connector 21 to the circuit board P2. The protrusions 22*g* hold the plug insulator 23, which is disposed inside the plug shell 22, in the plug shell 22.

A pair of locking members 26 are disposed in the first fitting section F1 of the first plug connector 21. Locking portions 26*a* of the locking members 26 protrude to the −Z direction side (downward) through a pair of openings 22*h* formed in the pair of upper step sections 22*d* of the lower plate section 22*b* of the plug shell 22.

Figure 12:
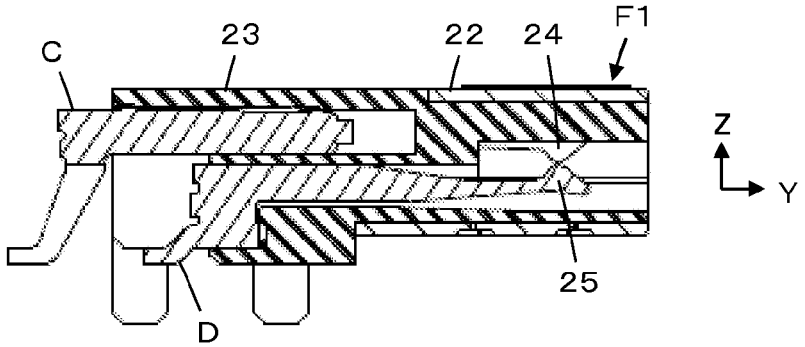
FIG. 12 is a cross-sectional view taken along line I-I of FIG. 11E.
Figure 13A:
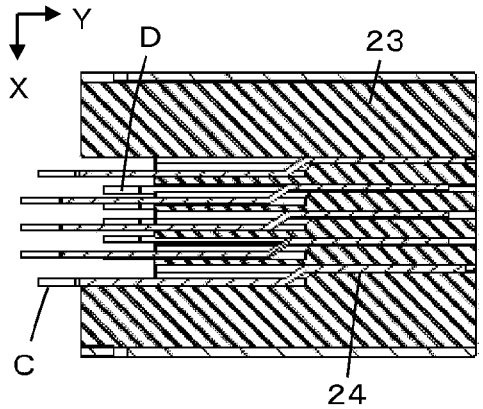
FIG. 13A is a cross-sectional view taken along line II-II of FIG. 11F
Figure 13B:
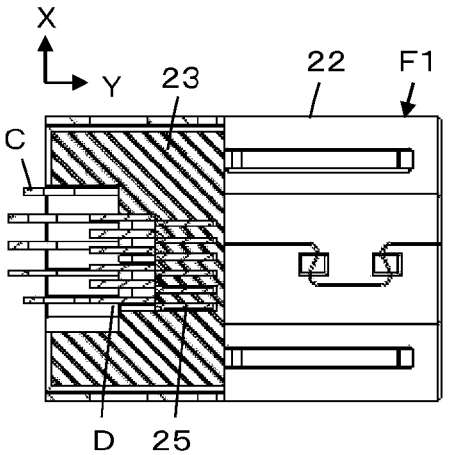
FIG. 13B is a cross-sectional view taken along line III-III of FIG. 11F.

The plug insulator 23 is inserted into the plug shell 22. As illustrated in FIG. 12 and FIGS. 13A and 13B, the plug insulator 23 extends from the end in the −Y direction to the end in the +Y direction in the internal space of the plug shell 22 and holds plug contact array C and plug contact array D.

Plug contact array C includes plural plug contacts 24 which extend in the Y direction along the fitting axis L and which are arranged in the X direction. Similarly, plug contact array D includes plural plug contacts 25 which extend in the Y direction along the fitting axis L and which are arranged in the X direction, that is, in the direction parallel to plug contact array C.

Plug contact array C and plug contact array D are arranged to overlap with each other with a predetermined gap interposed therebetween in the Z direction perpendicular to the arrangement direction thereof, and ends in the +Y direction of the plug contacts 24 of plug contact array C and ends in the +Y direction of plug contacts 25 of plug contact array D are arranged at the same position in the Y direction.

Figure 14A:
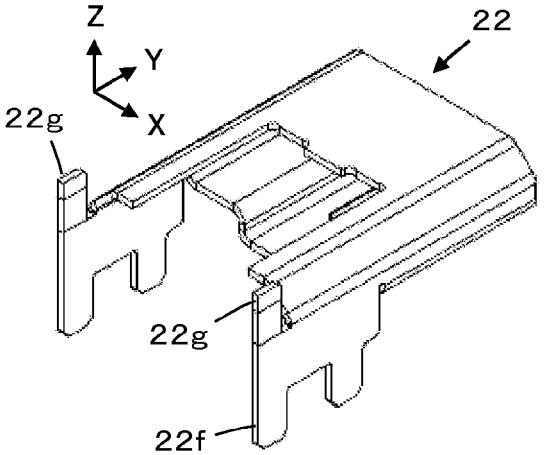
FIG. 14A is a perspective view of a plug shell used for the first plug connector before being assembled when viewed from the rear side and FIG. 14B is a perspective view thereof when viewed from the front side.
Figure 14B:
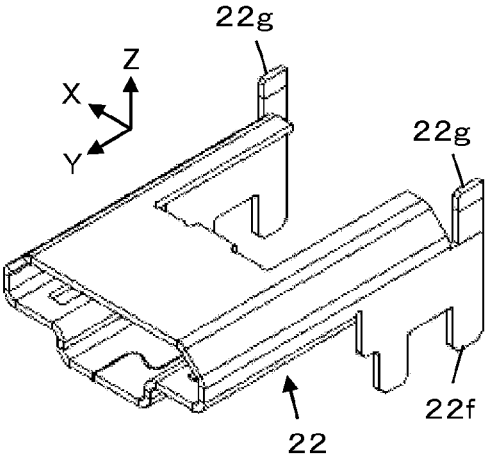

As illustrated in FIGS. 14A and 14B, the protrusions 22*g* extending from the upper end in the −Y direction of the plug shell 22 extend in the +Z direction (upward) without being bent before the plug insulator 23 is attached, and are bent so as to receive the end in the −Y direction of the plug insulator 23 after the plug insulator 23 is inserted into the plug shell 22. Accordingly, the plug insulator 23 disposed in the plug shell 22 is held in the plug shell 22.

Figure 15A:
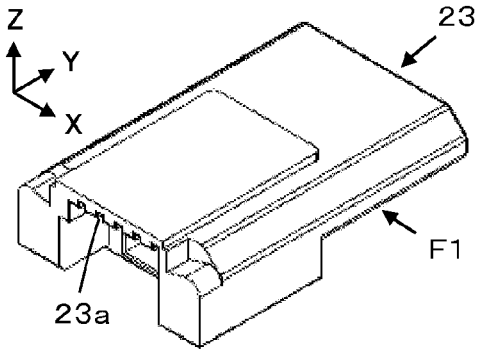
FIG. 15A is a perspective view of a plug insulator used for the first plug connector when viewed from the rear side and FIG. 15B is a perspective view thereof when viewed from the front side.
Figure 15B:
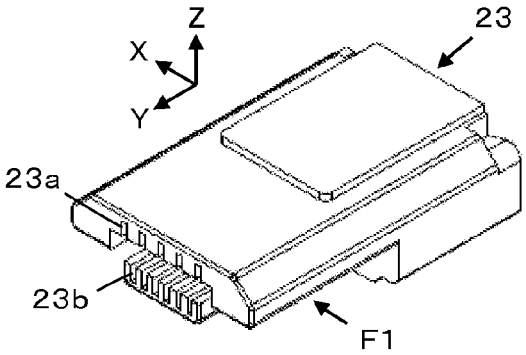

As illustrated in FIGS. 15A and 15B, plural grooves 23*a* for receiving a part of the plug contacts 24 of plug contact array C and plural grooves 23*b* for receiving a part of the plug contacts 25 of plug contact array D are formed at the end in the +Y direction of the plug insulator 23 corresponding to the first fitting section F1.

Figure 16A:
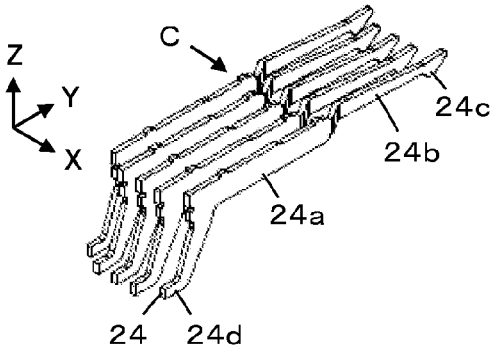
FIG. 16A is a perspective view of plug contact array C used for the first plug connector when viewed from the rear side and FIG. 16B is a perspective view thereof when viewed from the front side.
Figure 16B:
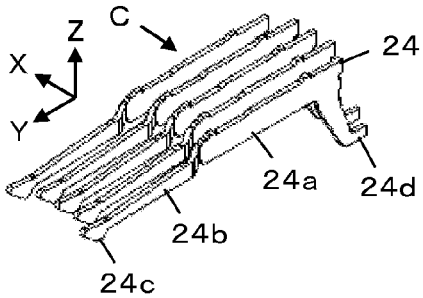

FIGS. 16A and 16B illustrate plug contact array C. Each of the plug contacts 24 of plug contact array C includes a held portion 24*a* embedded and held in the plug insulator 23, an extension portion 24*b* extending in the +Y direction from the held portion 24*a*, a contact portion 24*c* protruding in the −Z direction from the end in the +Y direction of the extension portion 24*b* and inserted into the groove 23*a* of the plug insulator 23, and a substrate-mounting portion 24*d* located on the −Y direction side of the held portion 24*a* and protruding from the back of the plug insulator 23.

The extension portion 24*b* and the contact portion 24*c* of each plug contact 24 are shifted from the held portion 24*a* and the substrate-mounting portion 24*d* in the X direction which is the arrangement direction of plug contact array C.

Figure 17A:
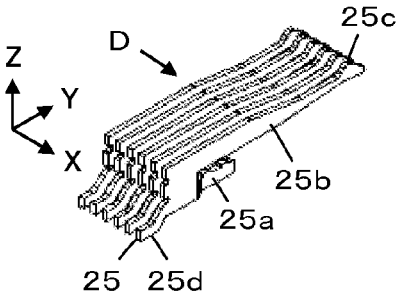
FIG. 17A is a perspective view of plug contact array D used for the first plug connector when viewed from the rear side and FIG. 17B is a perspective view thereof when viewed from the front side.
Figure 17B:
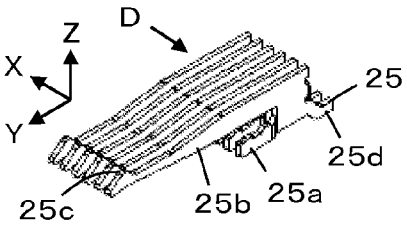

Similarly, FIGS. 17A and 17B illustrate plug contact array D. Each of the plug contacts 25 of plug contact array D includes a held portion 25*a* embedded and held in the plug insulator 23, an extension portion 25*b* extending in the +Y direction from the held portion 25*a*, a contact portion 25*c* protruding in the +Z direction from the end in the +Y direction of the extension portion 25*b* and inserted into the groove 23*b* of the plug insulator 23, and a substrate-mounting portion 25*d* located on the −Y direction side of the held portion 25*a* and protruding to the rear side of the plug insulator 23.

The extension portion 25*b*, the contact portion 25*c*, and the substrate-mounting portion 25*d* of each plug contact 25 are shifted from the held portion 25*a* in the X direction which is the arrangement direction of plug contact array D.

In this way, by forming a shifted portion shifted in the X direction in the respective plug contacts 24 of plug contact array C and the respective plug contacts 25 of plug contact array D, plug contact array C and plug contact array D can be easily arranged so that the held portions 24*a* of the plug contacts 24 of plug contact array C and the held portions 25*a* of the plug contacts 25 of plug contact array D do not overlap in the Z direction, and formation of a thin part of the plug insulator 23 between plug contact array C and plug contact array D can be avoided to secure strength of the first plug connector 21.

Figure 11A:
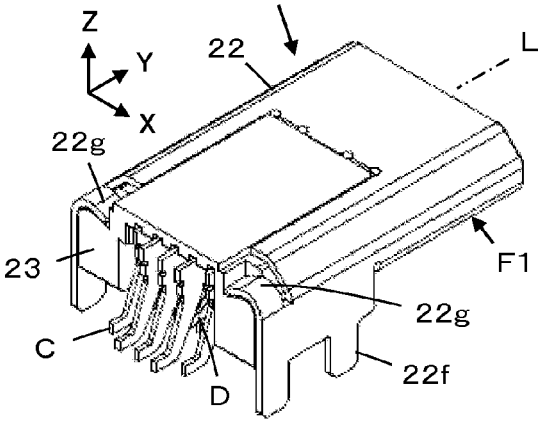
FIG. 11A is a perspective view of a first plug connector to be fitted to the receptacle connector when viewed from the rear side.
Figure 11B:
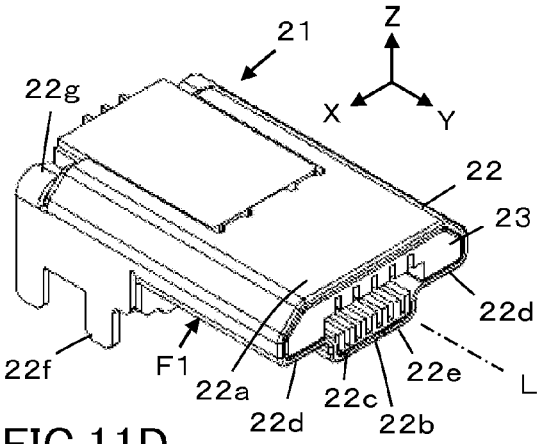
FIG. 11B is a perspective view thereof when viewed from the front side.
Figure 11C:
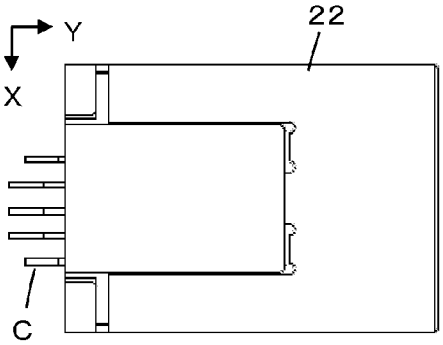
FIG. 11C is a plan view thereof.
Figure 11D:
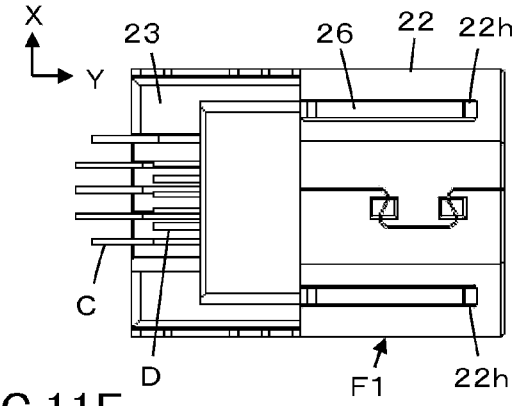
FIG. 11D is a bottom view thereof.
Figure 11E:
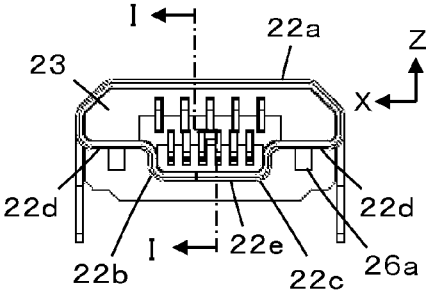
FIG. 11E is a front view.
Figure 11F:
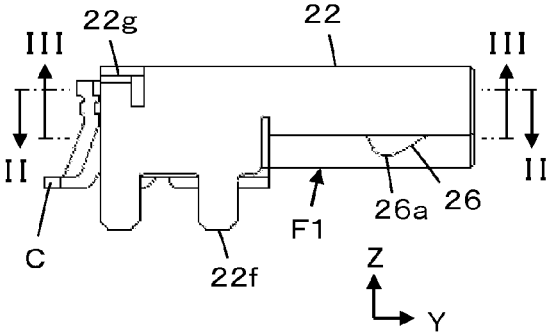
FIG. 11F is a side view thereof.
Figure 11G:
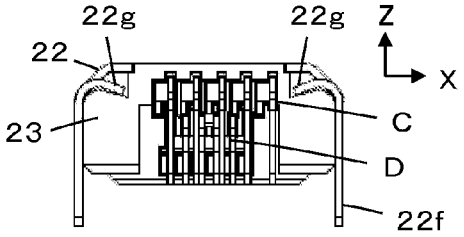
FIG. 11G is a rear view thereof.
Figure 18A:
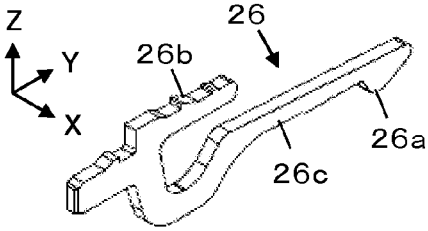
FIG. 18A is a perspective view of a locking member used for the first plug connector when viewed from the rear side and FIG. 18B is a perspective view thereof when viewed from the front side.
Figure 18B:
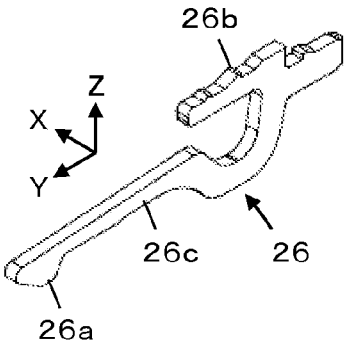

FIGS. 18A and 18B illustrate locking members 26. Each locking member 26 includes a held portion 26*b* embedded and held in the plug insulator 23, an extension portion 26*c* extends in the +Y direction from the held portion 26*b*, and a locking portion 26*a* which is formed at the end in the +Y direction of the extension portion 26*c* and protrudes in the −Z direction. The locking portion 26*a* has a spring property by presence of the extension portion 26*c*, is movable in the Z direction, and protrudes in the −Z direction from the opening 22*h* of the plug shell 22 as illustrated in FIGS. 11D to 11F.

Plug contact array C, plug contact array D, and the pair of locking members 26 can be attached to the plug insulator 23, for example, by insert molding using a resin. A part of the plug contacts 24 of plug contact array C are received in the grooves 23*a* of the plug insulator 23, and a part of the plug contacts 25 of plug contact array D are received in the grooves 23*b*.

As illustrated in FIG. 12, the substrate-mounting portions 24*d* of the respective plug contacts 24 of plug contact array C and the substrate-mounting portions 25*d* of the respective plug contacts 25 of plug contact array D are located at positions different in the Y direction from each other. Accordingly, when the first plug connector 21 is mounted on the circuit board P2, the substrate-mounting portions 24*d* and the substrate-mounting portions 25*d* can be soldered to wiring patterns of the circuit board P2 in a state where a space therebetween is satisfactorily secured.

Figure 19:
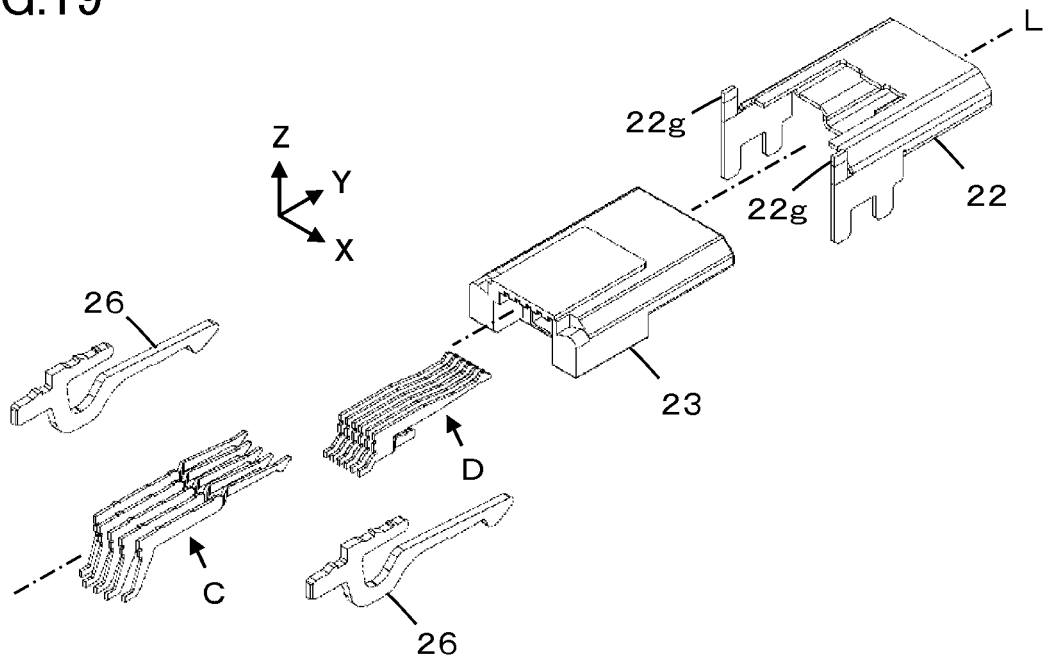
FIG. 19 is an exploded view of the first plug connector.

As illustrated in FIG. 19, the plug insulator 23 to which plug contact array C, plug contact array D and the pair of locking members 26 have been attached is inserted into the plug shell 22 from the end on the −Y direction side of the plug shell 22 along the fitting axis L, and the pair of protrusions 22*g* of the plug shell 22 are bent to receive the end in the −Y direction of the plug insulator 23 and to hold the plug insulator 23 in the plug shell 22, whereby the first plug connector 21 is prepared.

As illustrated in FIG. 11E, the first fitting section F1 formed at the end in the +Y direction of the first plug connector 21 has a shape corresponding to the first reception section S1 of the receptacle connector 11 when viewed from the direction of the fitting axis L.

Figure 20:
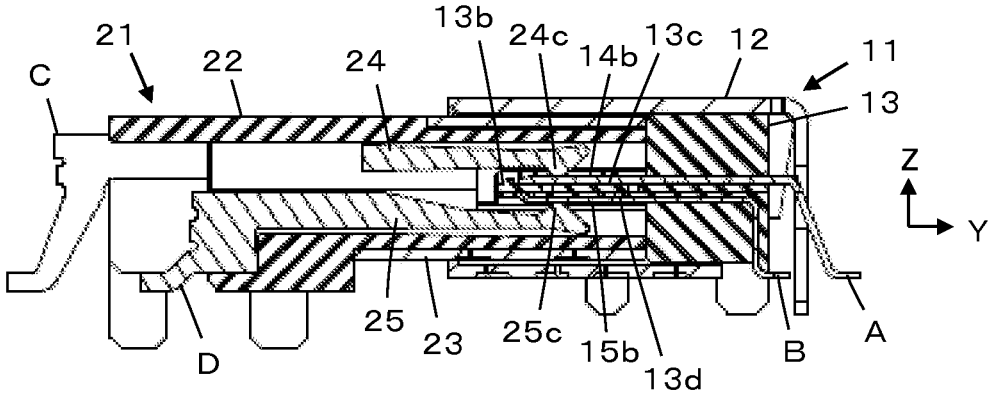
FIG. 20 is a cross-sectional view illustrating a state where the first plug connector is fitted to the receptacle connector.

By inserting the first fitting section F1 of the first plug connector 21 into the first reception section S1 of the receptacle connector 11 along the fitting axis L, the first plug connector 21 is fitted to the receptacle connector 11. At this time, as illustrated in FIG. 20, the tip of plug contact array C of the first plug connector 21 is located on the tongue-like section 13*b* of the receptacle connector 11 and the contact portions 24*c* of the plural plug contacts 24 constituting plug contact array C come in contact with the contact portions 14*b* of the plural receptacle contacts 14 constituting receptacle contact array A disposed on the upper surface 13*c* of the tongue-like section 13*b* of the receptacle connector 11. At the same time, the tip of plug contact array D is located below the tongue-like section 13*b* of the receptacle connector 11 and the contact portions 25*c* of the plural plug contacts 25 constituting plug contact array D come in contact with the contact portions 15*b* of the plural receptacle contacts 15 constituting receptacle contact array B disposed on the lower surface 13*d* of the tongue-like section 13*b* of the receptacle connector 11. Accordingly, plug contact arrays C and D of the first plug connector 21 are electrically connected to receptacle contact arrays A and B of the receptacle connector 11, respectively.

By inserting the first fitting section F1 of the first plug connector 21 into the first reception section S1 of the receptacle connector 11, the locking portions 26*a* of the pair of locking members 26 of the first plug connector 21 are inserted into the pair of openings 12*h* formed in the receptacle shell 12 of the receptacle connector 11 and thus the fitting state of the receptacle connector 11 and the first plug connector 21 is locked. By extracting the first fitting section F1 of the first plug connector 21 from the first reception section S1 of the receptacle connector 11 against the spring force of the locking members 26, the fitting state of the receptacle connector 11 and the first plug connector 21 can be unlocked.

FIGS. 21A to 21D illustrate a configuration of a second plug connector 31 which can be fitted to the second reception section S2 of the receptacle connector 11. The second plug connector 31 is a plug connector for general-purpose micro universal serial bus (μUSB), is not fixed to a circuit board but is attached to a tip of a cable 30, and includes a second fitting section F2 which is fitted to the second reception section S2 of the receptacle connector 11.

The second fitting section F2 includes a plug shell 32 having a shape corresponding to the shape of the second reception section S2 of the receptacle connector 11 when viewed from the direction of the fitting axis L, a plug insulator 33 disposed in the plug shell 32, and plug contact array E held by the plug insulator 33. In plug contact array E, plural plug contacts 34 are arranged in a line in the X direction so as to send and receive signals and power for USB.

A pair of locking members 36 are disposed in the second fitting section F2, and locking portions 36*a* of the locking members 36 protrude in the −Z direction through a pair of openings 32*a* formed in the surface of the plug shell 32 facing the −Z direction side.

Figure 22:
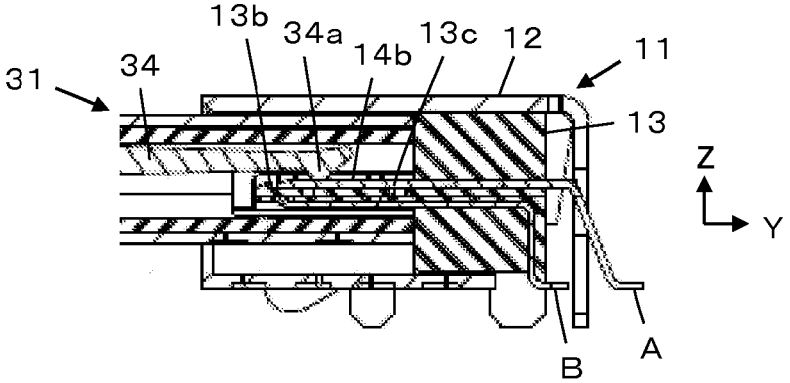
FIG. 22 is a cross-sectional view illustrating the receptacle connector to which the second plug connector is fitted.
Figure 23:
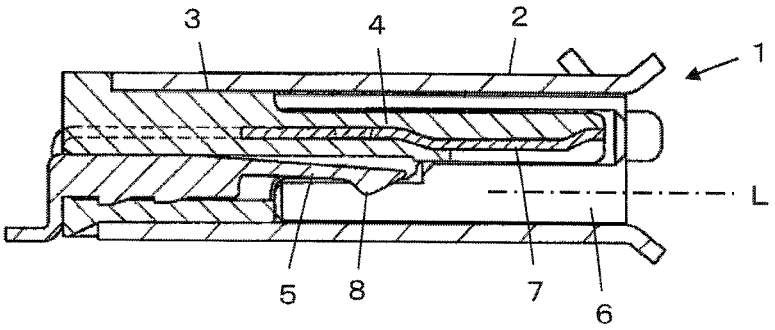
FIG.23 PRIOR ART
FIG. 23 is a cross-sectional view illustrating a conventional receptacle connector.
Figure 24:
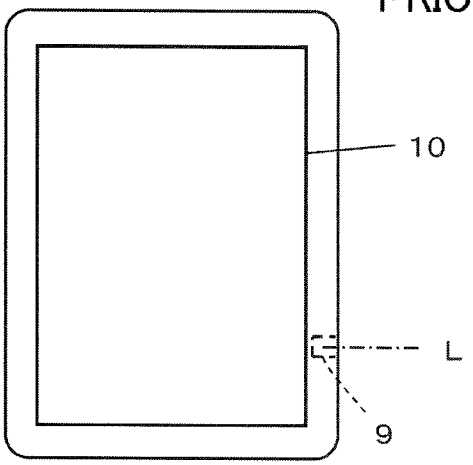
FIG.24 PRIOR ART
FIG. 24 is a plan view illustrating a portable device.

By inserting the second fitting section F2 into the second reception section S2 of the receptacle connector 11 along the fitting axis L, the second plug connector 31 is fitted to the receptacle connector 11. At this time, as illustrated in FIG. 22, the tip of plug contact array E of the second plug connector 31 is located on the tongue-like section 13*b* of the receptacle connector 11 and the contact portions 34*a* of the plural plug contacts 34 constituting plug contact array E come in contact with the contact portions 14*b* of the plural receptacle contacts 14 constituting receptacle contact array A disposed on the upper surface 13*c* of the tongue-like section 13*b* of the receptacle connector 11. Accordingly, plug contact array E of the second plug connector 31 is electrically connected to receptacle contact array A of the receptacle connector 11.

By inserting the second fitting section F2 of the second plug connector 31 into the second reception section S2 of the receptacle connector 11, the locking portions 36*a* of the pair of locking members 36 of the second plug connector 31 is inserted into the pair of openings 12*h* formed in the receptacle shell 12 of the receptacle connector 11 and thus the fitting state of the receptacle connector 11 and the second plug connector 31 is locked. By extracting the second fitting section F2 of the second plug connector 31 from the second reception section S2 of the receptacle connector 11 against the spring force of the locking members 36, the fitting state of the receptacle connector 11 and the second plug connector 31 can be unlocked.

In this way, the receptacle connector 11 according to this embodiment can be fitted to either of the first plug connector 21 having μUSB plug contact array C and non-μUSB plug contact array D and having the first fitting section F1, and the second plug connector 31 having μUSB plug contact array E and having the second fitting section F2 different in shape from the first fitting section F1 of the first plug connector 21.

In the receptacle connector 11, the contact portions 14*b* of the plural receptacle contacts 14 constituting receptacle contact array A of the receptacle connector 11 and the contact portions 15*b* of the plural receptacle contacts 15 constituting receptacle contact array B face the opposite directions to each other, both the plural contact portions 14*b* of receptacle contact array A and the plural contact portions 15*b* of receptacle contact array B are connected to the plural contact portions 24*c* of plug contact array C and the plural contact portions 25*c* of plug contact array D of the first plug connector 21 when the first plug connector 21 is fitted, and the plural contact portions 14*b* of receptacle contact array A are connected to the contact portions 34*a* of plug contact array E of the second plug connector 31 when the second plug connector 31 is fitted. Accordingly, it is possible to reduce the length of the receptacle connector 11 in the direction of the fitting axis L.

Figure 21A:
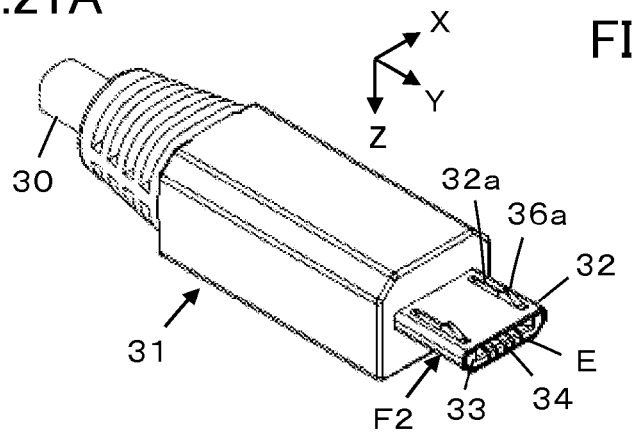
FIG. 21A is a perspective view illustrating a second plug connector to be fitted to the receptacle connector.
Figure 21B:
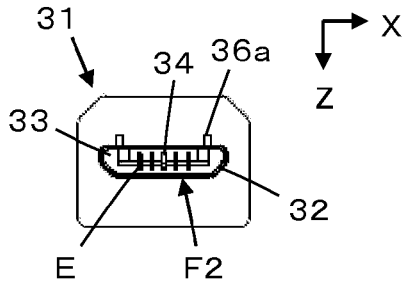
FIG. 21B is a front view thereof.
Figure 21C:
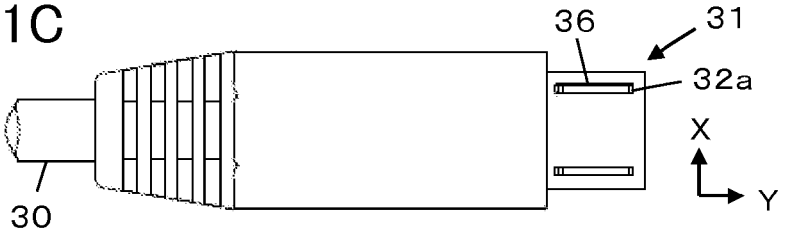
FIG. 21C is a plan view thereof.
Figure 21D:
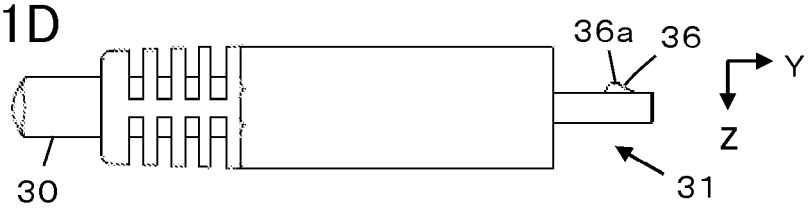
FIG. 21D is a side view thereof.

In the above-mentioned embodiment, the first plug connector 21 is fixed to the circuit board P2 using the protrusions 22*f* of the plug shell 22, but the first plug connector may be attached to the tip of the cable 30 like the second plug connector 31 illustrated in FIG. 21A or may be mounted on a flexible printed circuit board (FPC).

In addition, in the above-mentioned embodiment, the respective plug contacts 24 of plug contact array C of the first plug connector 21 and the respective plug contacts 25 of plug contact array D have the shifted part, but the shifted part may not be formed in the plug contacts when the thickness of the plug insulator 23 located between plug contact array C and plug contact array D can be secured.

In the above-mentioned embodiment, either of the first plug connector 21 having μUSB plug contact array C and non-μUSB plug contact array D and the second plug connector 31 having only μUSB plug contact array E is fitted to the receptacle connector 11 having μUSB receptacle contact array A and non-μUSB receptacle contact array B, but a plug connector having only a non-μUSB plug contact array may be fitted to the receptacle connector 11.

In the above-mentioned embodiment, the receptacle connector 11 has μUSB receptacle contact array A and non-μUSB receptacle contact array B, but the receptacle contact array used is not limited to a receptacle contact array for μUSB. For example, the receptacle connector may have a USB receptacle contact array and a non-USB receptacle contact array, or may have a mini-USB receptacle contact array and a non-mini-USB receptacle contact array, or may have a receptacle contact array for another standardized data bus and a receptacle contact array for a non-standardized data bus. In the same way as described in the above-mentioned embodiment, a receptacle connector can be implemented which can be fitted to both a first plug connector having a plug contact array for the standardized data bus and a plug contact array for the non-standardized data bus and a second plug connector having only a plug contact array for the standardized data bus and whose length in the direction of the fitting axis is reduced.

A receptacle connector may have two receptacle contact arrays standardized in different standards and may have connection compatibility with a first plug connector having two plug contact arrays standardized in these standards and a second plug connector having only one plug contact array standardized in one of these standards.

What is claimed is:

1. A receptacle connector which is fitted to either of a plug connector having a first fitting section and a plug connector having a second fitting section different in shape from the first fitting section along a same fitting axis, comprising:

a receptacle shell in which a first reception section for receiving the first fitting section and a second reception section for receiving the second fitting section are formed to overlap at least partly with each other; and a receptacle contact array A and a receptacle contact array B, both having a plurality of contact portions that are arranged in a region of the receptacle shell where the first reception section and the second reception section overlap with each other, wherein the plurality of contact portions of the receptacle contact array A and the plurality of contact portions of the receptacle contact array B face in opposite directions to each other, wherein when the plug connector having the first fitting section is fitted to the receptacle connector, both the plurality of contact portions of the receptacle contact array A and the plurality of contact portions of the receptacle contact array B are connected to the plug connector having the first fitting section, and when the plug connector having the second fitting section is fitted to the receptacle connector, the plurality of contact portions of the receptacle contact array A are connected to the plug connector having the second fitting section.

2. The receptacle connector according to claim 1, wherein the receptacle contact array A includes a plurality of receptacle contacts that are arranged in a direction perpendicular to the fitting axis and that make connections for signals and power with a standardized data bus, and wherein the receptacle contact array B includes a plurality of receptacle contacts that are arranged in a direction perpendicular to the fitting axis and parallel to the receptacle contact array A and that make connections for signals or signals and power with a bus other than the standardized data bus.

3. The receptacle connector according to claim 2, wherein the standardized data bus is a micro universal serial bus.

4. The receptacle connector according to claim 1, wherein the receptacle contact array A and the receptacle contact array B are arranged to overlap with each other with a predetermined space therebetween in a direction perpendicular to their arrangement directions, and wherein the plurality of contact portions of the receptacle contact array A and the plurality of contact portions of the receptacle contact array B are arranged at a same position in the fitting axis direction.

5. The receptacle connector according to claim 4, wherein the receptacle shell includes a convex section in which a part of the receptacle shell facing the receptacle contact array B swells in a direction perpendicular to an arrangement direction of the plurality of receptacle contacts, and wherein a part of the first reception section is formed in the convex section.

6. The receptacle connector according to claim 5, wherein the receptacle shell includes a pair of openings for holding locking members of the plug connector having the first fitting section or the plug connector having the second fitting section in a fitting state, and wherein the convex section is formed between the pair of openings.

7. The receptacle connector according to claim 1, further comprising a receptacle insulator that is disposed in the receptacle shell and that has a tongue-like portion extending in the fitting axis direction in a region where the first reception section and the second reception section overlap and having a pair of surfaces facing opposite directions to each other, wherein the receptacle contact array A and the receptacle contact array B are held by the receptacle insulator, the plurality of contact portions of the receptacle contact array A being arranged on one of the pair of surfaces of the tongue-like portion while the plurality of contact portions of the receptacle contact array B being arranged on the other of the pair of surfaces of the tongue-like portion.

8. The receptacle connector according to claim 7, wherein each of the receptacle contact array A and the receptacle contact array B includes a plurality of substrate-mounting portions protruding from a back of the receptacle insulator, the plurality of substrate-mounting portions of the receptacle contact array A and the plurality of substrate-mounting portions of the receptacle contact array B are arranged at different positions in the fitting axis direction.

9. A plug connector comprising:

the first fitting section that is to be received in the first reception section of the receptacle connector according to claim 1;

a plug contact array C that corresponds to the receptacle contact array A; and a plug contact array D that corresponds to the receptacle contact array B, wherein a plurality of contact portions of the plug contact array C and a plurality of contact portions of the plug contact array D are arranged so as to face each other, and wherein when the plug connector is fitted to the receptacle connector, the plurality of contact portions of the plug contact array C are connected to the plurality of contact portions of the receptacle contact array A and the plurality of contact portions of the plug contact array D are connected to the plurality of contact portions of the receptacle contact array B.

10. The plug connector according to claim 9, wherein the plug contact array C and the plug contact array D are arranged so as to overlap with each other with a predetermined space therebetween in a direction perpendicular to their arrangement directions, and wherein the plurality of contact portions of the plug contact array C and the plurality of contact portions of the plug contact array D are arranged at a same position in the fitting axis direction.

11. The plug connector according to claim 10, further comprising a plug insulator that holds the plug contact array C and the plug contact array D, wherein in a plurality of plug contacts constituting the plug contact array C and the plug contact array D, the contact portions and held portions held by the plug insulator are shifted from each other in arrangement directions of the plug contact array C and the plug contact array D.

12. A connector assembly comprising:

the receptacle connector according to claim 1;

a first plug connector including the first fitting section that is to be received in the first reception section of the receptacle connector;

a plug contact array C that corresponds to the receptacle contact array A; and a plug contact array D that corresponds to the receptacle contact array B, wherein a plurality of contact portions of the plug contact array C and a plurality of contact portions of the plug contact array D are arranged so as to face each other, and wherein when the plug connector is fitted to the receptacle connector, the plurality of contact portions of the plug contact array C are connected to the plurality of contact portions of the receptacle contact array A and the plurality of contact portions of the plug contact array D are connected to the plurality of contact portions of the receptacle contact array B; and a second plug connector that includes the second fitting section which is to be received in the second reception section of the receptacle connector and a plug contact array E corresponding to the receptacle contact array A and in which a plurality of contact portions of the plug contact array E are connected to the plurality of contact portions of the receptacle contact array A when the second plug connector is fitted to the receptacle connector, wherein one of the first plug connector and the second plug connector is fitted to the receptacle connector.

13. A receptacle connector which is fitted to either of a plug connector having a first fitting section and a plug connector having a second fitting section different in shape from the first fitting section along a same fitting axis, comprising:

a receptacle shell in which a first reception section for receiving the first fitting section and a second reception section for receiving the second fitting section are formed to overlap at least partly with each other; and a receptacle contact array A and a receptacle contact array B, both having a plurality of contact portions that are arranged in a region of the receptacle shell where the first reception section and the second reception section overlap with each other, wherein the plurality of contact portions of the receptacle contact array A and the plurality of contact portions of the receptacle contact array B face in opposite directions to each other, wherein when the plug connector having the first fitting section is fitted to the receptacle connector, at least the plurality of contact portions of the receptacle contact array B out of the plurality of contact portions of the receptacle contact array A and the plurality of contact portions of the receptacle contact array B are connected to the plug connector having the first fitting section, and when the plug connector having the second fitting section is fitted to the receptacle connector, the plurality of contact portions of the receptacle contact array A are connected to the plug connector having the second fitting section, wherein the receptacle contact array A and the receptacle contact array B are arranged to overlap with each other with a predetermined space therebetween in a direction perpendicular to their arrangement directions, and the plurality of contact portions of the receptacle contact array A and the plurality of contact portions of the receptacle contact array B are arranged at a same position in the fitting axis direction, and wherein the receptacle shell includes a convex section in which a part of the receptacle shell facing the receptacle contact array B swells in a direction perpendicular to an arrangement direction of the plurality of receptacle contacts, and a part of the first reception section is formed in the convex section.

14. The receptacle connector according to claim 13, wherein the receptacle shell includes a pair of openings for holding locking members of the plug connector having the first fitting section or the plug connector having the second fitting section in a fitting state, and wherein the convex section is formed between the pair of openings.

* * * * *